US005359938A

United States Patent [19]

Campoli et al.

[11] Patent Number: 5,359,938

[45] Date of Patent: Nov. 1, 1994

[54] ULTRA LIGHT WEIGHT SABOT

[75] Inventors: Ralph F. Campoli, Mine Hill, N.J.; Edwin G. Steiner, York, Pa.

[73] Assignee: Olin Corporation, St. Petersburg, Fla.

[21] Appl. No.: 602,831

[22] Filed: Oct. 24, 1990

[51] Int. Cl.[5] ..... F42B 14/06

[52] U.S. Cl. ..... 102/521; 102/703

[58] Field of Search ..... 102/520–523, 102/703

[56] References Cited

U.S. PATENT DOCUMENTS

| | | | |
|---|---|---|---|
| 3,055,268 | 9/1962 | Rosenthal | 102/523 |
| 3,490,329 | 1/1970 | Pratorius | 102/523 |
| 4,284,008 | 8/1981 | Kirkendall et al. | 102/521 |
| 4,326,464 | 4/1982 | Price | 102/523 |
| 4,384,529 | 5/1983 | Burns et al. | 102/520 |
| 4,444,113 | 4/1984 | Campoli | 102/521 |
| 4,487,131 | 12/1984 | Luther | 102/520 |
| 4,517,899 | 5/1985 | Haberli | 102/521 |
| 4,524,695 | 6/1985 | Bisping et al. | 102/520 |
| 4,608,927 | 9/1986 | Romer et al. | 102/521 |
| 4,911,079 | 3/1990 | Sauvestre | 102/521 |
| 4,920,889 | 5/1990 | Luther | 102/521 |

FOREIGN PATENT DOCUMENTS

| | | | |
|---|---|---|---|
| 158828 | 10/1985 | European Pat. Off. | 102/520 |
| 3704027 | 8/1988 | Germany | 102/521 |
| 3803864 | 8/1989 | Germany | 102/520 |
| 3825289 | 2/1990 | Germany | 102/521 |

*Primary Examiner*—Harold J. Tudor

*Attorney, Agent, or Firm*—Gregory S. Rosenblatt; John R. Wahl

[57] ABSTRACT

An ultra light weight sabot for a subcaliber projectile comprises a sabot having three reduced mass segments each incorporating driving grooves at their inner diameter, an aft bourrelet, a central cavity beneath the aft bourrelet and an outwardly directed projection forward of the aft bourrelet to support the forward end of the projectile as it travels through a gun bore. The aft bourrelet has a balloon type obturator thereon which also fastens to the cartridge case. A bore extending through the obturator and the aft bourrelet into the annular cavity equalizes pressure between the case and the annular cavity to assist in sabot segment separation from the subcaliber projectile.

50 Claims, 2 Drawing Sheets

ULTRA LIGHT WEIGHT SABOT

BACKGROUND OF THE INVENTION

The present invention is generally related to saboted projectiles and more particularly to armor piercing fin stabilized discarding sabot (APFSDS) tank ammunition.

The present known gun systems have reached their peaks as far as pressure limitations, so further minor improvement to the weapon system is not generally believed to be practical. A major change such as a new high pressure gun system is generally thought to be needed to achieve the muzzle velocities required to defeat the newer armor targets. These types of drastic changes, of course, are expensive and time consuming to develop.

It is also generally believed that the present state of the art for direct tank fired ammunition is reaching a point of diminishing returns. It appears that without a major breakthrough in sabot fired rounds the "state of the art" armor target will become superior to the penetrator performance, rendering all present rounds obsolete.

Because of gun design limitations that now exist, design consideration is now being directed toward drastic changes to the parasitic hardware (the sabot) by using newer, higher strength materials, and sabot configurations that provide higher strength sabot structures which will permit the reduction in weight of the parasitic hardware.

In conventional sabot designs, it is known that there are areas of the sabot structure that will permit the reduction in material weight without jeopardizing the sabot integrity. In addition, the forward bell (or front bourrelet), used as a support for the forward end of the flight projectile (penetrator) during acceleration in the gun and as an aerodynamic lifting surface during the discard process can, especially in the case of high L/D (20 or more) projectile designs, contribute too much lift on forward end of the sabot segment. In this case the sabot segment interferes with the flight projectile at the aft end inducing high initial yaw contributing to inaccuracy.

One proposed solution to this type of problem was recently disclosed in U.S. Pat. No. 4,920,889. In this case, a groove or a series of holes are provided at the base of the forward bell so that it will separate from its segment upon emergence of the projectile from the gun muzzle. This early separation of the bell portion is designed to minimize the effect of the sabot segment rotation on the penetrator as the segment rotates out and away from the penetrator body upon launch. However, separation is not parallel to the path of the projectile and therefore rotation still has an undesirable effect on projectile accuracy.

Another approach is disclosed in U.S. Pat. No. 4,608,927. In this design the front bourrelet is replaced with three bore riding ribs which prevent balloting in the bore of the gun and allow passage of air into an annular scoop or pocket formed in the forward perimeter of the rear bourrelet so as to catch passing air that is void of turbulence and thus minimize oscillations during flight of the projectile.

A still further approach to mass reduction in a sabot assembly is disclosed in U.S. Pat. No. 4,326,464. In this patent a plurality of longitudinal gussets are used to reduce the overall weight and mass of the sabot while retaining the necessary strength to withstand acceleration forces during launch and provide the desired separation without adversely affecting penetrator flight.

U.S. Pat. No. 4,284,008 teaches placement of the obturator at about the center of gravity of the subcaliber penetrator and distributing the forces of launch using a double tapered or ramp configuration fore and aft of the obturating band to enhance inbore stability.

U.S. Pat. No. 4,524,695 teaches the use of a plurality of equally spaced bore riding fins aft of the obturator and adjacent the fins on the penetrator projectile. These bore riding fins assist in stabilizing the projectile during launch through the gun bore to minimize inbore instability.

SUMMARY OF THE INVENTION

The object of the present invention therefore is to provide an improved kinetic energy (APFSDS) projectile with a sabot having a reduced mass to increase muzzle velocity high enough to defeat the newer targets. This of course must be achieved without an increase to the chamber pressures of the presently available tank guns.

The sabot of the present invention eliminates the "standard" front bourrelet replacing it with an "I beam" type radial support member for support in the gun during acceleration. Secondly, sabot discard is improved by adding an aerodynamic scoop at the forward side of the centrally located aft bourrelet thus causing the sabot segments to lift away from the penetrator in a parallel fashion ensuring a non-interfering discard, thus producing a very accurate flight projectile launch. Third, substantial mass reduction is achieved by the formation of an annular cavity beneath the obturator on the aft bourrelet adjacent the penetrator without sacrificing structural strength of the sabot segments as a whole. These drastic changes also permitted removal of all the aluminum at the outer peripheral surface of the forward bourrelets with the exception of end surfaces of the three projections used to act as bourrelets and support for the penetrator at the forward end of each segment. These changes in the sabot design in accordance with the present invention result in an approximate 25% to 30% decrease in sabot weight over conventional sabot designs.

Another area permitting a reduction in parasitic hardware weight is the new design obturator of the invention. The obturator fits around the periphery of the aft or rear bourrelet. The aft bourrelet also serves as a high pressure bulkhead against which the propellant gases act upon ignition of the propelling charge. The obturator provides the seal between the bulkhead of the aft bourrelet and the gun bore.

Conventional obturators require self feeding between the gun bore and the obturator. The present invention operates in accordance with a different principle.

The obturator of the sabot of the present invention is designed so that the rear face of the bulkhead is covered with a thin wall of a plastic annular cup that extends up outwardly to the bore wall and rearwardly to the cartridge case mouth. Propellant gases are encapsulated in the cup shaped obturator at which time the obturator wall is forced against the bore and the bulkhead which provides the added support needed to withstand the high chamber pressure.

To further reduce sabot weight without jeopardizing metal parts security, a considerable amount of material, about 5% by weight or about 5% by volume, is removed from the internal area of the bulkhead. This is permitted because of the balanced fore and aft design concept of the lightweight sabot.

To achieve the foregoing objective in accordance with the purpose of this invention as embodied and broadly described herein, the ultra light weight sabot of this invention comprises a sabot assembly having at least three generally arcuate segments on a penetrator assembly. Each sabot segment has an inner radial surface incorporating driving means for engaging corresponding means on the long rod penetrator core for maintaining contact between the segments and the penetrator during launch of the projectile. The driving means usually includes coacting buttress type driving grooves which engage complementary ridges or vice versa machined into the outer surface of the penetrator. The axial extent or length of the driving grooves and ridges will be dependent upon the overall length of the penetrator core and the loads exerted on the groove/-ridge interface during projectile acceleration when the gun fired.

Each sabot segment has a front ramp portion and a rear ramp portion extending axially from a bulkhead portion, the outer margin of which constitutes an aft bourrelet. Extending radially outwardly near the front end of the front ramp portion on each segment is a radial bore rider projection. These projections each provide radial support to the penetrator at the forward end of each ramp to prevent projectile balloting in the bore as it travels down bore. These projections thus act as a front bourrelet.

The outer surface of each of the projections is an arcuate surface machined to a radius which is approximately 0.005 inch less than the bore radius so as to provide a total clearance of approximately 0.015 inches. Each support also preferably incorporates an arcuate "T" shaped aluminum pad with a curved stainless steel insert which provides a riding surface contacting the gun bore.

These three slender projections on the sabot in accordance with the invention are in contrast to the conventional bell shaped scoop used on current standard APFSDS-T rounds. Conventional sabots incorporate forward bell shaped scoops which are an integral part of the sabot. The forward bell conventionally constitutes the forward bourrelet which provides radial support for the forward end of the flight projectile and a provides an air engaging lift surface to raise and help strip the forward end of each segment from the penetrator during sabot discard. The conventional sabot segments essentially pivot or rotate outward away from the penetrator.

The present invention (purposely) does not require the forward scoop for discard. All that is needed is the radial support at the forward end of the projectile assembly as it travels down the bore. Accordingly, the projections are all that are required, thus contributing to a decrease in sabot weight.

The required aerodynamic lift and drag surface is provided in the sabot assembly of the invention by the annular concave shape of the forward face of the bulkhead portion. This surface is approximately located at the longitudinal center of each sabot segment and at approximately the center of gravity of the penetrator. Locating the lift surface at about the center of gravity tends to produce a more parallel lift of the sabot segment off of and away from the penetrator upon launch. This concept of parallel lift is not presently used on other conventional sabots. The location of the lift at the forward face of the bulkhead portion provides a more uniform discard of the sabot with less disturbance to the penetrator without acting through a moment arm or torsioning during separation.

Since the forward bell scoop of the conventional designs has been essentially moved rearward to the aft bourrelet, the air stream necessarily flows past the radial supports during projectile launch through the gun bore into the scoop provided at the bulkhead portion. This arrangement produces a radially outwardly directed lift force on each segment at a preferred location, the sabot center of gravity. This will produce a much more uniform lift of each segment without any interreaction between sabot segments and improves the launching characteristics and accuracy performance.

An axially extending integral reinforcing rib is located on each ramp portion. The reinforcing rib extends the full length of the portion to provide added stiffness and has a generally trapezoidal cross section for strength.

The sabot segments in the sabot assembly are retained in position about the penetrator assembly by front and rear retaining rings around the ends of the segments. These rings bind the sabot segments and the penetrator assembly together during handling and transportation. However, upon launch, they break, permitting separation of the sabot segments as described.

The distance between the front and aft bourrelets is known as the required wheel base. A long wheel base is critical to minimizing down bore balloting. The greater the distance, the less the down bore balloting which contributes considerably to good accuracy dispersion. The sabot of the present invention permits a considerably longer wheel base due to its long ramp characteristics than has previously been available.

The aft bourrelet on the bulkhead portion of the sabot of the invention incorporates a new design obturator. This new obturator design permits a reduction in cross section area which will still successfully withstand the chamber pressures of the high pressure guns used in present day tank systems.

The new concept obturator is designed to act as a pressure capsule. The obturator in accordance with the invention is a flexible annular plastic cup having a split doughnut shape that encircles the rear face of the bulkhead of the aft bourrelet and covers part of the rear ramp portion which blends into the bulkhead. The outer portion of the annular obturator has a diameter approximately equal to the bore of the gun. This portion extends coaxially rearward and is fastened to the combustible case mouth preferably with plastic pop rivets.

The inner perimeter of the annular cup is sized so as to stretch fit onto the rear ramp portion of the sabot segments. The inner perimeter preferably engages corresponding annular shoulders formed on the rear ramp portion to snap fit the obturator in place on the sabot segments.

When the propellant charge in the combustible case is ignited, the evolving gases fill the annular cup shaped obturator, forcing the plastic walls forward and outward against the bulkhead and against the walls of the gun bore producing an immediate tight seal. This flexible obturator prevents low and high pressure gases from escaping between the rear bourrelet and the gun tube walls.

Total discard of the flexible annular obturator occurs almost immediately upon projectile emergence from the gun muzzle. This is caused by the internal gases accumulated in the annular cup shaped obturator as it travels down bore. Upon passage of the outer perimeter of the annular cup shaped obturator past the muzzle, the internal pressure no longer acts against the gun tube. This extreme pressure ruptures the plastic annular cup freeing the segments of the sabot for discard. The passing air scooped against the front face of the aft bourrelet then lifts the segments away from the penetrator. This method of discarding the obturator and sabot segments results in better launching characteristics and improved accuracy.

One of the most significant design features of the sabot in accordance with the present invention is the formation of an annular cavity beneath the aft bourrelet. Just below the bulkhead of the aft bourrelet, a considerable amount of material has been removed without producing any detrimental effects to the strength of the sabot design. This is successfully accomplished because the stresses induced to the core of the sabot by setback forces during acceleration have been found to be considerably lower at this location than the stresses in the area of the ramp portions on both sides of the bulkhead.

Another design feature of the invention is a pressure equalization bore through the obturator and the rear face of each of the sabot segments into the cavity beneath the aft bourrelet. This hole permits pressurization of the cavity during projectile acceleration down the gun bore to actively assist in sabot separation upon exit of the projectile from the gun muzzle.

The ultra light weight sabot of the invention is preferably made of a polymer composite or may be made of aluminum. It will withstand the high G loads experienced in the present tank guns. The overall reduction in weight compared to conventional sabot designs is considerable, contributing to a round that will have the necessary muzzle velocity to defeat the present and near future targets when fired from present day tank guns.

These and other objects, features and advantages of the invention will become more apparent from a reading of the following detailed description when taken in conjunction with the drawing and appended claims.

DESCRIPTION OF THE PREFERRED EMBODIMENT

Figure 1:
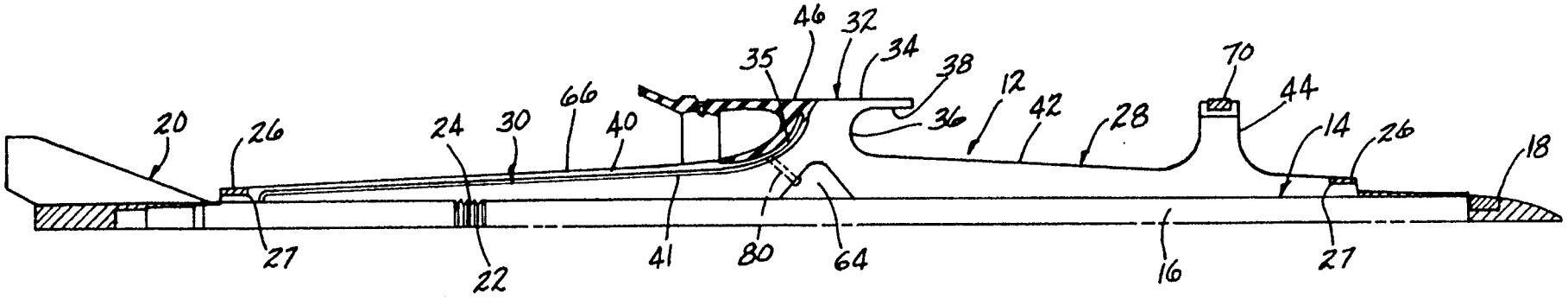
FIG. 1 is a partial sectional plan view of half of a projectile assembly including the ultra light weight sabot assembly in accordance with the invention.
Figure 2:
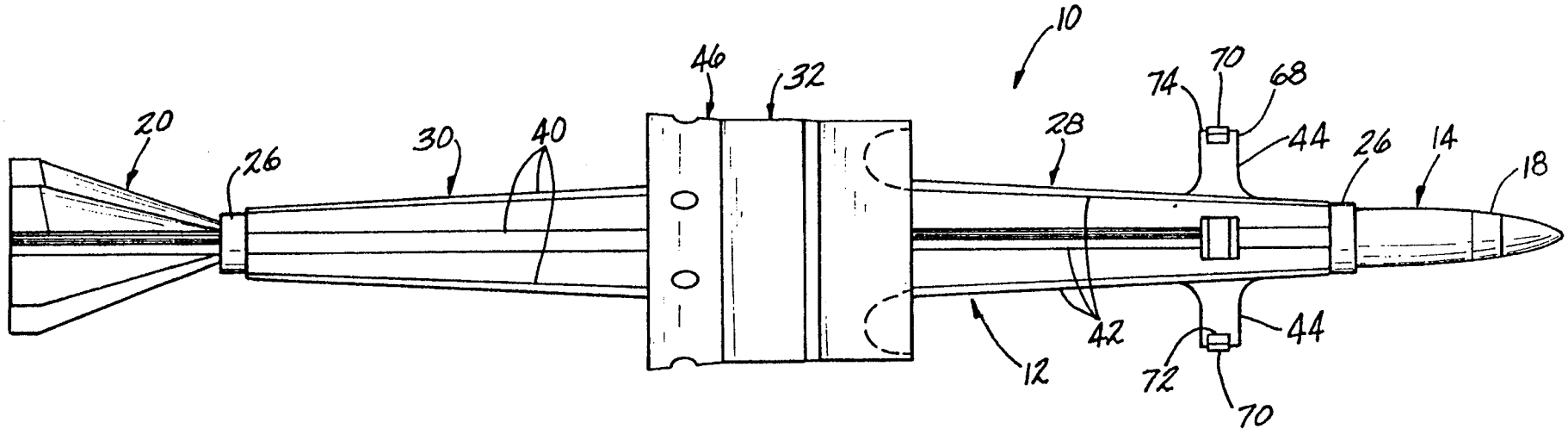
FIG. 2 is an outer plan view of the projectile assembly including the ultra light weight sabot assembly.

The sabot assembly 10 in accordance with the invention is preferably divided into three 120 degree segments 12. With reference to FIG. 1, a sabot segment 12 is shown assembled to a long rod penetrator projectile assembly 14. In FIG. 2, the complete sabot assembly 10 is shown assembled to the penetrator projectile assembly 14. The penetrator assembly 14 includes a long rod penetrator body 16, an aerodynamic wind shield 18 on the nose of the penetrator body 16, and a finned tail assembly 20 attached to the rear of the penetrator body 16 to stabilize it during flight.

The segments 12 encircle the penetrator body 16 and are axially secured to the penetrator body 16 by engagement between complementary grooves and ridges 22 and 24 machined into the inner radial surface of the sabot segments and the outer surface of the penetrator body 16 respectively. These grooves and ridges, preferably of the buttress type, provide the driving connection between the penetrator assembly 14 and the sabot assembly 10. The buttress grooves 22 and ridges 24 preferably extend the full length of the sabot segment 12.

The sabot assembly 10 is radially secured to the penetrator assembly 14 by annular bands 26 around the fore and aft ends of the assembly. These bands 26 are conventional and are designed to separate upon launch of the projectile from the gun tube.

Each sabot segment 12 comprises a front ramp portion 28 and a rear ramp portion 30 separated by an integral bulkhead portion 32. The bulkhead portion 32 has an outer diameter about equal to the bore diameter of the gun tube (not shown) and thus constitutes a rear bourrelet. The bulkhead portion 32 has a curved outer surface 34, a concave rear face 35 and a concave front face 36. The outer surface 34 of the bulkhead portion 32 comes into intimate contact with the gun bore and therefore its diameter is controlled to maintain a minimum clearance of about 0.015 inches between the bourrelet surface 34 and the gun bore.

The front concave faces 36 of each segment 12 together form an annular scoop 38 to capture the oncoming rushing air upon launch. This action produces a radially outwardly directed force on the sabot segments 12 which snaps the annular bands 26 and strips the sabot segments 12 off of the penetrator assembly 14 after muzzle emergence.

This design in accordance with the invention provides all of the lift at the center of each sabot segment 12 which is also the center of gravity of the segment producing a more uniform, i.e. parallel clearance between the sabot segment 12 and the penetrator assembly 14 as the segments 12 are discarded.

The rear ramp portion 30 tapers axially and extends rearward from the bulkhead portion 32 to the end of the sabot segment 12. The rear ramp portion 30 is designed specifically to carry the rear section of the penetrator body 16. In addition, the cross sectional shape of the rear ramp portion 30 is designed to maintain the necessary strength to carry the rearward end of the penetrator body 16. At the same time, the rear ramp portion weight is reduced as much as possible. Accordingly, the cross sectional area of the rear ramp portion increases closer to the bulkhead portion. An integral elongated raised rib 40 also projects radially from each rear ramp portion 30 and extends down the center of each rear ramp portion 30. The rib 40 also has an elongated groove or indentation 41 in both sides of the rib, giving the rib a general "T" shape cross section. This further reduces the weight without diminishing the overall strength of the portion. The increase in cross sectional area at the forward part of the rear ramp portion 30 provides considerable stiffness which is needed to withstand the in bore balloting during launch Tapering forwardly from the bulkhead portion 32, the front ramp portion 28 similarly provides support to the forward end of the penetrator body 16. Accordingly, the cross sectional area of the front ramp portion 28 increases closer to the bulkhead portion. An integral rib 42 also projects radially from each front ramp portion 28 and extends down the center of each front ramp portion 28. The increase in cross sectional area at the rear part of the front ramp portion 28 also provides the stiffness needed to withstand the in bore balloting during launch.

Extending radially from the front ramp portion 28 approximately three inches rearward from the end of the segment 12, is a stabilizing post 44. Each segment 12 has one of these posts 44 located in the middle of the ramp portion 28 at this location. These posts 44 are required to maintain stability of the forward end of the penetrator assembly 14. The stabilizing post 44 extends from the rib 42 on the front ramp portion 28 out to the gun bore diameter thus constituting a front bourrelet. A close clearance between the front bourrelet and the gun bore is provided which is similar to that provided at the rear bourrelet.

The distance between the two bourrelets, i.e. front posts 44 and the bulkhead portion 32 is called the wheel base. The longer the wheel base the lower the amount of in bore balloting during down bore travel. In the sabot of the present invention, the wheel base is maximized thus minimizing the in bore balloting. This translates into an improved flight characteristic for the penetrator assembly.

Figure 3:
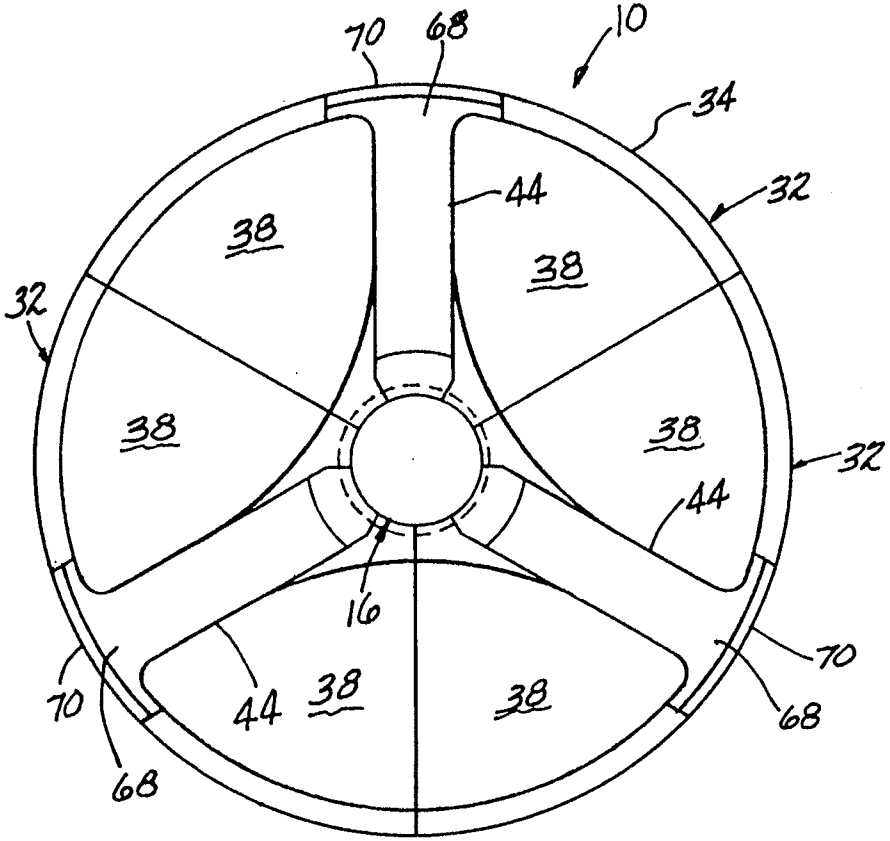
FIG. 3 is a front end view of the projectile assembly shown in FIG. 2.

As shown in the frontal view FIG. 3, there is no obstruction between the three stabilizing posts 44 of the sabot assembly 10. During launch, this permits the on flowing high velocity air to impact into the lifting scoop 38 which causes the sabot segments 12 to lift off of the penetrator assembly 14 in a generally parallel manner producing a uniform discard.

A flexible balloon type obturator 46 is attached to and form rests against the rear face 35 of the bulkhead portion 32. It is an annular cup shaped capsule manufactured from a high strength flexible synthetic material. It is designed to both expand forwardly against the rear face 35 of the bulkhead portion 32 and outwardly against the gun bore to seal against the propellant gasses during projectile launch.

The annular capsule obturator 46 has a rearwardly extending inner rim 48, an inwardly projecting and forwardly protruding annular wedge portion 50, and a rearwardly extending outer rim 52. The annular wedge portion 48 is snap engaged with a corresponding annular shoulder obturation support 54 jutting radially outwardly from the rear face 35 of the bulkhead portion 32 inward of the outer surface 34. The smaller inner rim 48 of the annular cup shaped balloon obturator 46 snaps into an annular groove 56 provided on each of the ribs 40 on the rear ramp portions 30.

The obturator 46 is fastened to the sabot segments by the engagement of the inner rim 48 with the groove 56 and the engagement of the wedge portion 50 with the obturation support 54. The obturator 46 is thus locked into position preventing it from backing off of the assembly 10 during cartridge handling, loading and firing.

Figure 4:
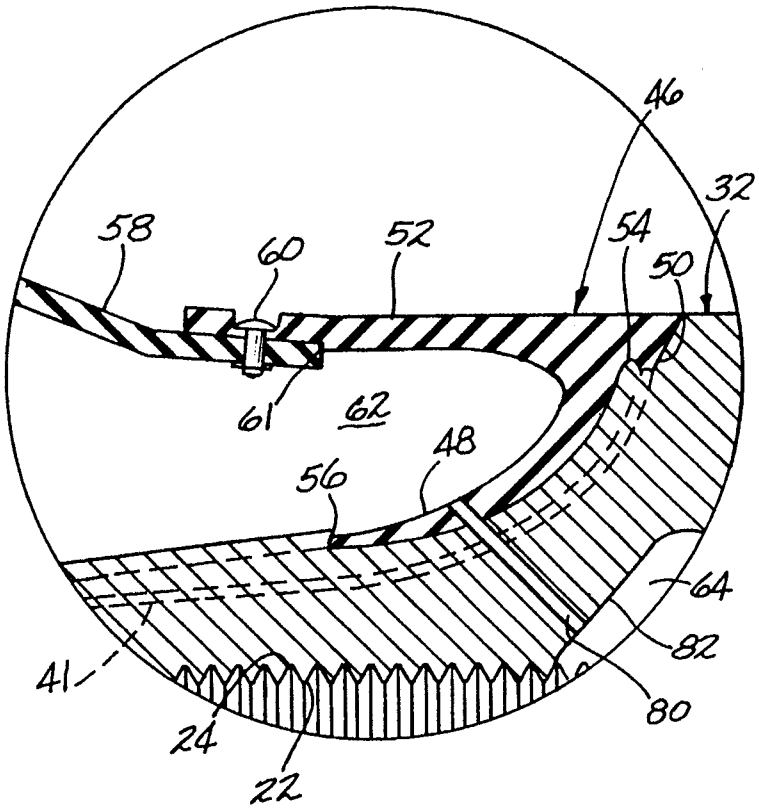
FIG. 4 is an enlarged partial sectional plan view of the obturator portion of the sabot assembly of the invention shown in FIG. 1.

The outer rim 52 of the balloon type obturator 46 extends rearwardly and is fastened to the mouth of a cartridge case 58 as is illustrated in FIG. 4. The mouth of the case engages an internal annular shoulder 61 near at the rear end of the outer rim 52. Thus the rear end of the obturator 46 accepts and fits over the case mouth 58 to securely attach thereto. Finally, the outer rim 52 is secured to the mouth of the case which may be combustible or metallic with suitable rivits or bolts 60 through corresponding holes in both parts.

The cavity 62 formed behind the balloon obturator 46 is open to the propellant charge in the cartridge case 58 and therefore will be pressurized during propellant ignition forcing the outer rim 52 and the wedge portion 50 against the gun bore and against the bulkhead portion 32 producing a complete seal therebetween, preventing any gases from bleeding out past the obturator 46. In addition, as there are gaps between the adjacent rear ramp portions 30 and the inner rim 48 due to the engagement of the rim with the shoulder groove 56, chamber pressure will be felt on both sides of the inner rim 48.

The loads produced by the internal chamber pressure during ignition force the projectile assembly down bore until it reaches the muzzle. At this time, the instant the outer rim 52 of the balloon obturator 46 is exposed, inner and outer rims 48 and 52 of the plastic obturator 46 collapse outward due to the internal gas pressure. The total collapse of the obturator is instantaneous, stretching the intermediate wedge portion and releasing the sabot segments 12. The high velocity oncoming air pressure at the same time impinges on the lifting scoop 38 lifting and discarding all three segments 12 simultaneously with minimum interaction between sabot segments 12 and the penetrator assembly 14.

To further reduce the overall weight of the parasitic hardware, material was removed from the bulkhead portion 32 just below the rear bourrelet i.e. under outer surface 34 adjacent to the penetrator body 16. This material removal creates an annular cavity 64 adjacent the penetrator body 16. This area of the sabot is the region adjacent the penetrator body 16 where a transition in stress occurs due to the loading of the penetrator body 16 adjacent ramp portions 28 and 30 during launch. The forward section of the penetrator 16 is in compression while the rear section of the penetrator is in tension.

At both ends of the sabot, the annular bands 26 are press fitted onto the ends and are forced into position against a shoulder 27. These bands are used to maintain the sabot segments 12 together on the penetrator assembly. The bands are designed to have a low shear break strength so that they do not interfere with sabot discard.

To prevent chamber gases from entering the crack between adjacent sabot segments 12, a plastic sealing sleeve of sealant 66 is applied over the entire rear ramp portion 30. It extends from the rear band 26 to the inner rim 48 of the balloon obturator 46. An alternative, also successfully tested, is a lengthwise groove machined along the joint between the rear ramp portions that extends the same length as the plastic sealant 66. The groove 41 is occupied by the same type plastic sealant 66 as that used on the outer diameter of the rear ramp portion 30. In order that a complete seal is maintained, a puddle of plastic sealer 66 should also be applied between the rear retaining band 26 and the penetrator body 16.

With reference to the front end view of FIG. 3, the view shows three segments 12 assembled with the penetrator assembly 14 in position. The stabilizing posts 44 are centered on the radial midpoint of each segment 12 and extend radially out to the bore diameter of the gun tube. The stabilizing posts 44 each incorporates at an outer end an aluminum T-pad 68 which receives and supports a section of stainless steel hose 70. The posts 44 and T-pads 68 are designed with sufficient strength to prevent post breakage during projectile spinup. The sections 70 are assembled into dovetail slots 72 in the outer end surface 74 of each T-pad 68. The stainless steel sections 70 are required to reduce the amount of wear to the aluminum T-pad 68 as they travel down bore.

Finally, there is a a bleed hole or bore 80 bored through the obturator 46 and the rear face 35 of the bulkhead portion 32 of each segment 12 into each arcuate portion of the annular cavity 64. This hole 80 allows the propellant gas pressure developed during projectile acceleration to equalize between the cavity 62 behind the obturator and the annular cavity 64. This pressure equalization results in an additional outward force to lift the segments off of the penetrator assembly upon muzzle exit. To ensure that the annular cavity 64 retains the gas pressure, a thin coating 82 of SRTV or other sealant is preferably provided on and between the inner surfaces of the bullkhead portion 32 forming the annular cavity 64 and the underlying grooves 22 and ridges 24 of the penetrator sealing this cavity.

The new ultra light weight sabot in accordance with the present invention achieves the required sabot weight reduction resulting in achievement of the improved performance goal. The new sabot of the invention is based on many years of experience and knowledge gained with similar rounds that have been successfully type classified. The design takes into consideration the highly stressed areas of the sabot and those areas not so highly stressed. Based on the above knowledge, the conventional sabot was redesigned in an effort to reduce the maximum amount of weight. The redesign accounts for the effect the design will have on the aerodynamic characteristics of the sabot segments during discard after muzzle emergence, as well as sabot integrity in the gun during acceleration.

While the invention has been described above with reference to a preferred embodiment thereof, it is to be understood that various variations, changes, modifications and alterations may be made without departing from the intended scope of the invention as defined by the appended claims. Accordingly, it is intended that the invention includes all such variations and alterations. All patents, patent applications, and references identified herein are hereby incorporated by reference in their entirety.

What is claimed is:

1. A sabot assembly for a projectile having an axis, an outer surface, an a radius, said sabot assembly comprising:

a plurality of sabot segments adjoining one another to define an annulus extending in an axial direction along the surface of the projectile having a radial width which combined with the radius of the projectile is less than a radius of a gun bore through which the projectile and sabot assembly is fired, each of said sabot segments including opposite front and rear ramped portions and a bulkhead portion centrally located intermediate said front and rear ramped portions;

said bulkhead portion having an arcuate outer surface with a selected arc length for slidably abutting an inner surface of the gun bore, a concave rear face, and a concave front face substantially about the center of gravity of said segment facing said front ramped portion;

said segments together with said projectile defining therebetween a single annular cavity around said projectile beneath said bulkhead portion and between said front and rear ramped portions to minimize the mass of said bulkhead portion while maintaining the strength of said bulkhead portion.

2. A sabot assembly according to claim 1, further including a projection spaced from said bulkhead portion and extending radially from said front portion outward toward said inner surface of said gun bore.

3. A sabot assembly according to claim 2 wherein said projection has an arcuate outer surface.

4. A sabot assembly according to claim 3 wherein said arcuate outer surface of said bulkhead portion has an arc length greater than the arc length of said arcuate outer surface of said projection.

5. A sabot assembly according to claim 1 further comprising gripping means for preventing axial motion between said sabot assembly and said penetrator projectile.

6. A sabot assembly according to claim 5, further including a projection spaced from said bulkhead portion and extending radially from said front portion outward toward said inner surface of said gun bore.

7. A sabot assembly according to claim 6 wherein said projection has an arcuate outer surface.

8. A sabot assembly according to claim 7 wherein said arcuate outer surface of said bulkhead portion has an arc length greater than the arc length of said arcuate outer surface of said projection.

9. A sabot assembly according to claim 1 wherein at least one of said front and rear portions has an elongated radially raised central rib extending a substantial distance along said portion.

10. A sabot assembly according to claim 9, wherein both said front and rear portions have raised ribs extending axially along said portions from said bulkhead portion.

11. A sabot assembly according to claim 9 wherein said front portion has an elongated central rib extending in the axial direction intermediate said bulkhead portion and the radial projection.

12. A sabot assembly according to claim 9 further including at least one elongated indentation disposed in an outer surface of said elongated central rib.

13. A sabot assembly according to claim 1, further including an annular cup shaped obturator removably attached to said rear face of said bulkhead portion.

14. A sabot assembly according to claim 13 wherein said obturator has an outer rim portion, an inner rim portion, and a central wedge portion between said rim portions.

15. A sabot assembly according to claim 14 wherein said wedge portion engages an annular shoulder formed by an arcuate obturation support projecting from each of the rear faces of the bulkhead portions of said sabot segments.

16. A sabot assembly according to claim 15 wherein said outer rim portion of said obturator extends rearwardly and outwardly to engage and seal said gun bore.

17. The sabot assembly according to claim 16 wherein said outer rim portion is adapted to be fastened to a cartridge case with a plurality of rivets.

18. A sabot assembly for a projectile having an axis, an outer surface, and a radius, said sabot assembly comprising:

a plurality of sabot segments adjoining one another to define an annulus extending in an axial direction along the surface of the projectile having a radial width which combined with the radius of the projectile is less than a radius of a gun bore through which the projectile and sabot assembly is fired, each of said sabot segments including opposite front and rear ramped portions and a bulkhead portion intermediate said front and rear ramped portions;

said bulkhead portion having an arcuate outer surface with a selected arc length for slidably abutting an inner surface of the gun bore, a concave rear face, and a concave front face substantially about the center of gravity of said segment facing said front ramped portion;

said segments together with said projectile defining therebetween a single annular cavity around said projectile beneath said bulkhead portion and between said front and rear ramped portions to minimize the mass of said bulkhead portion while maintaining the strength of said bulkhead portion; and a flexible plastic annular cup shaped obturator removably attached to said rear face of said bulkhead portion.

19. A sabot assembly according to claim 18 further including a projection spaced from said bulkhead portion and extending radially from said front portion outward toward said inner surface of said gun bore.

20. A sabot assembly according to claim 19 wherein said projection has an arcuate outer surface.

21. A sabot assembly according to claim 20 wherein said arcuate outer surface of said bulkhead portion has an arc length greater than the arc length of said arcuate outer surface of said projection.

22. A sabot assembly according to claim 18 further comprising gripping means for preventing axial motion between said sabot assembly and said penetrator projectile.

23. A sabot assembly according to claim 22 further including a projection spaced from said bulkhead portion and extending radially from said front portion outward toward said inner surface of said gun bore.

24. A sabot assembly according to claim 23 wherein said projection has an arcuate outer surface.

25. A sabot assembly according to claim 24 wherein said arcuate outer surface of said bulkhead portion has an arc length greater than the arc length of said arcuate outer surface of said projection.

26. A sabot assembly according to claim 18 wherein at least one of said front and rear portions has an elongated radially raised central rib extending a substantial distance along said portion.

27. A sabot assembly according to claim 26 wherein both said front and rear portions have raised ribs extending axially along said portions from said bulkhead portion.

28. A sabot assembly according to claim 26 wherein said front portion has an elongated central rib extending in the axial direction intermediate said bulkhead portion and the radial projection.

29. A sabot assembly according to claim 26 further including at least one elongated indentation disposed in an outer surface of said elongated central rib.

30. A sabot assembly according to claim 26 wherein said obturator has an outer rim portion, an inner rim portion, and a central wedge portion between said rim portions.

31. A sabot assembly according to claim 30 wherein said wedge portion engages an annular shoulder formed by an arcuate obturation support projecting from each of the rear faces of the bulkhead portions of said sabot segments.

32. A sabot assembly according to claim 31 wherein said outer rim portion of said obturator extends rearwardly and outwardly to engage and seal said gun bore.

33. The sabot assembly according to claim 32 wherein said outer rim portion is fastened to a cartridge case with a plurality of rivets.

34. A sabot assembly for a projectile having an axis, an outer surface, and a radius, said sabot assembly comprising:

a plurality of sabot segments adjoining one another to define an annulus extending in an axial direction along the surface of the projectile having a radial width which combined with the radius of the projectile is less than a radius of a gun bore through which the projectile and sabot assembly is fired, each of said sabot segments including opposite front and rear ramped portions and a bulkhead portion intermediate said front and rear ramped portions;

said bulkhead portion having an arcuate outer surface with a selected arc length for slidably abutting an inner surface of the gun bore, a concave rear face, and a concave front face substantially about the center of gravity of said segment facing said front ramped portion;

said segments together with said projectile defining therebetween a single annular cavity around said projectile beneath said bulkhead portion and between said front and rear ramped portions to minimize the mass of said bulkhead portion while maintaining the strength of said bulkhead portion, said bulkhead portion of each segment having a bore therethrough extending from said rear face to said cavity.

35. A sabot assembly according to claim 34, further including a projection spaced from said bulkhead portion and extending radially from said front portion outward toward said inner surface of said gun bore.

36. A sabot assembly according to claim 35 wherein said projection has an arcuate outer surface.

37. A sabot assembly according to claim 36 wherein said arcuate outer surface of said bulkhead portion has an arc length greater than the arc length of said arcuate outer surface of said projection.

38. A sabot assembly according to claim 34 further comprising gripping means for preventing axial motion between said sabot assembly and said penetrator projectile.

39. A sabot assembly according to claim 38, further including a projection spaced from said bulkhead portion and extending radially from said front portion outward toward said inner surface of said gun bore.

40. A sabot assembly according to claim 39 wherein said projection has an arcuate outer surface.

41. A sabot assembly according to claim 40 wherein said arcuate outer surface of said bulkhead portion has an arc length greater than the arc length of said arcuate outer surface of said projection.

42. A sabot assembly according to claim 34 wherein at least one of said front and rear portions has an elongated radially raised central rib extending a substantial distance along said portion.

43. A sabot assembly according to claim 42, wherein both said front and rear portions have raised ribs extending axially along said portions from said bulkhead portion.

44. A sabot assembly according to claim 42 wherein said front portion has an elongated central rib extending in the axial direction intermediate said bulkhead portion and the radial projection.

45. A sabot assembly according to claim 42 further including at least one elongated indentation disposed in an outer surface of said elongated central rib.

46. A sabot assembly according to claim 34, further including an annular cup shaped obturator removably attached to said rear face of said bulkhead portion, said obturator having a hole therethrough aligning with said bore.

47. A sabot assembly according to claim 46 wherein said obturator has an outer rim portion, an inner rim portion, and a central wedge portion between said rim portions.

48. A sabot assembly according to claim 47 wherein said wedge portion engages an annular shoulder formed by an arcuate obturation support projecting from each of the rear faces of the bulkhead portions of said sabot segments.

49. A sabot assembly according to claim 48 wherein said outer rim portion of said obturator extends rearwardly and outwardly to engage and seal said gun bore.

50. The sabot assembly according to claim 49 wherein said outer rim portion is adapted to be fastened to a cartridge case with a plurality of rivets.

* * * * *